US005699910A

United States Patent [19]

Kubat

[11] Patent Number: 5,699,910

[45] Date of Patent: Dec. 23, 1997

[54] MECHANIC'S TRAY

[76] Inventor: Danny Kubat, 518 Alondra Dr., Huntington Beach, Calif. 92626

[21] Appl. No.: 576,408

[22] Filed: Dec. 19, 1995

[51] Int. Cl.[6] ..... B65D 85/28

[52] U.S. Cl. ..... 206/373; 206/818; 224/562; 248/206.5

[58] Field of Search ..... 206/372–373, 206/234, 557, 818; 224/555, 556, 562, 564; 248/206.5, 683, 467, 207, 188.2; 150/166

[56] References Cited

U.S. PATENT DOCUMENTS

| | | | |
|---|---|---|---|
| 4,826,059 | 5/1989 | Bosch et al. | 224/183 |
| 4,907,769 | 3/1990 | Hunley, Jr. et al. | 248/206.5 |
| 5,078,281 | 1/1992 | Johnson | 248/206.5 |
| 5,111,342 | 5/1992 | Quesada | 248/467 |
| 5,221,006 | 6/1993 | Plumlee et al. | 206/350 |
| 5,331,904 | 7/1994 | DiSimone et al. | 108/44 |
| 5,460,305 | 10/1995 | Ahearn | 224/562 |

*Primary Examiner*—Paul T. Sewell
*Assistant Examiner*—Nhan T. Lam
*Attorney, Agent, or Firm*—Edgar W. Averill, Jr.

[57] ABSTRACT

A mechanic's tray for holding parts while servicing machinery. The tray has a floor and four walls. A pair of independently pivotal magnet assemblies are held to the walls of the tray which permits the mechanic to affix the tray to an uneven surface. Preferably the magnets each have a cushioning sheet held against the back of the magnet which cushioning sheets may be folded over so that they cover the face of the magnet to protect any painted surfaces.

5 Claims, 2 Drawing Sheets

MECHANIC'S TRAY

BACKGROUND OF THE INVENTION

The field of the invention is receptacles and the invention relates more particularly to trays for holding parts.

It has been recognized that during a repair operation of for instance an automobile engine that it is common that many small parts such as nuts and bolts and washers be removed as the portion of the engine being worked on is disassembled. Many times there is no convenient spot to place these small parts and every mechanic has had the experience of having a nut or bolt fall into the engine compartment. Several magnetically held trays have been devised to help alleviate this problem. One such tray is shown in U.S. Pat. No. 4,911,083 where the tray has a magnet positioned in the center of the floor of the tray. While this tray is useful in instances where there is a horizontal ferromagnetic surface, there are many repair jobs where this is not the case.

Another tray which also requires a generally horizontal surface is shown in U.S. Pat. No. 5,405,004.

A tray with somewhat more flexibility is shown in U.S. Pat. No. 5,078,281 where a magnet is held on a U-shaped arm which is pivotal about the tray. This tray, however, also requires a relatively large flat, although not necessarily horizontal, surface for appropriate use. Sometimes the repair job is along the side of the vehicle, for instance for affixing some molding and it is important that the magnets be protectible from a painted surface so that no scratching results.

SUMMARY OF THE INVENTION

It is an object of the present invention to provide a mechanic's tray which is affixable to a non-horizontal non-flat surface by magnets.

It is another object of the present invention to provide a mechanic's tray held to a ferromagnetic surface in a manner which will not scratch the surface.

The present invention is for a mechanic's tray for holding parts while servicing machinery. The tray assembly includes a tray having a floor and four walls. A first magnet assembly is pivotly held by one wall and includes means for tightening the magnet assembly to the tray. A second magnet assembly is pivotly held by the tray and independently moveable with respect to the first magnet assembly. The second magnet assembly also includes means for holding the magnet assembly in a desired position. Preferably each magnet has a cushioning sheet which may be folded across the face of the magnet to protect the object to which it is held from being scratched.

DESCRIPTION OF THE PREFERRED EMBODIMENTS

Figure 1:
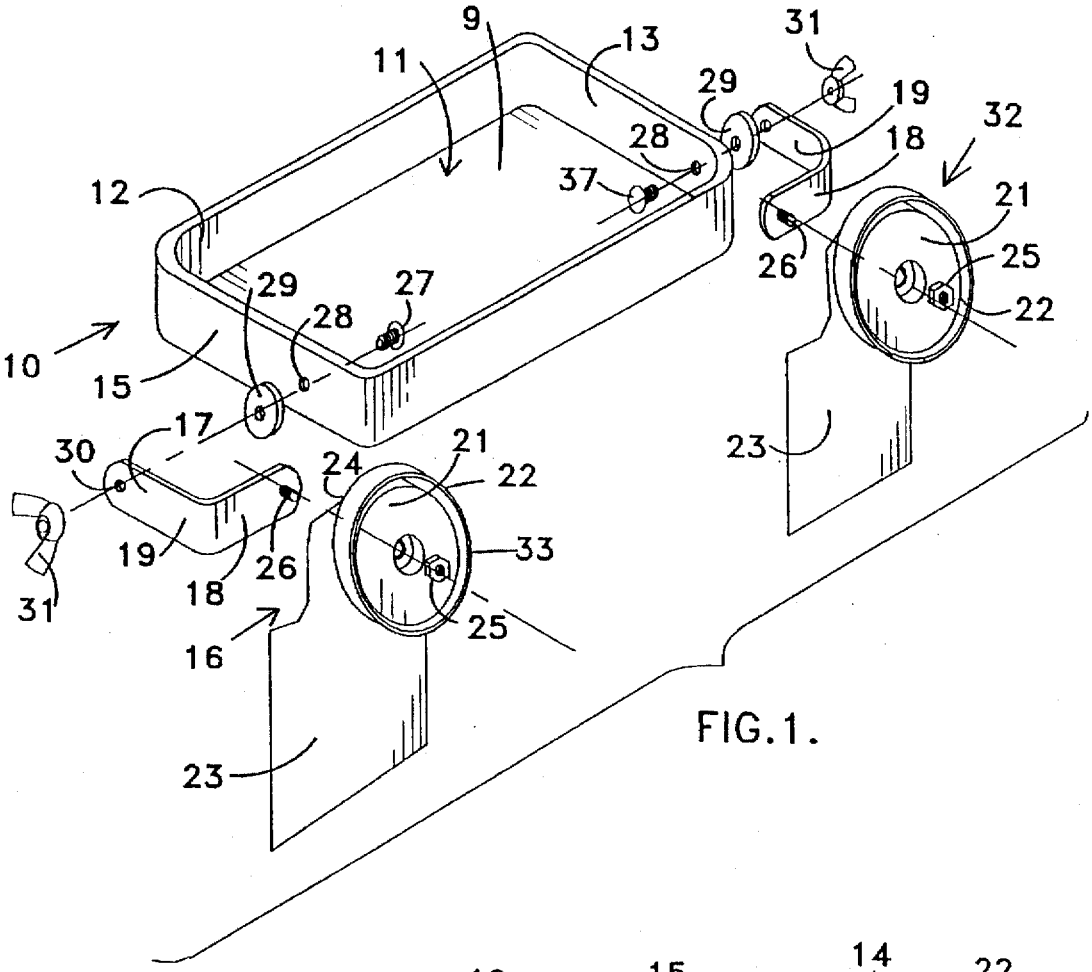
FIG. 1 is an exploded perspective view of the mechanic's tray of the present invention.
Figure 2:
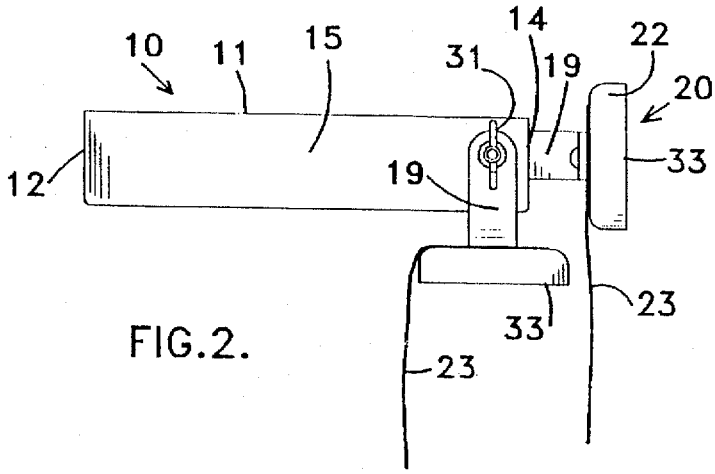
FIG. 2 is a side view thereof.

A mechanic's tray assembly is shown in exploded perspective view in FIG. 1 and indicated generally by reference character 10. The tray assembly 10 includes a floor 9, a tray 11 with four walls, namely a front wall 12, a right side wall 13, a back wall 14 and a left side wall 15. A first magnet assembly 16 includes an angled support member 17 having a magnet arm portion 18 and a tray arm portion 19. A magnet 20 is a cup style magnet with a doughnut shaped magnet portion 21 surrounded by a ferromagnetic cup 22. A cushioning sheet 23 is held against the back 24 of cup 22 and against magnet arm portion 18. A nut 25 is secured to a bolt 26 held by magnet arm portion 18.

Figure 4:
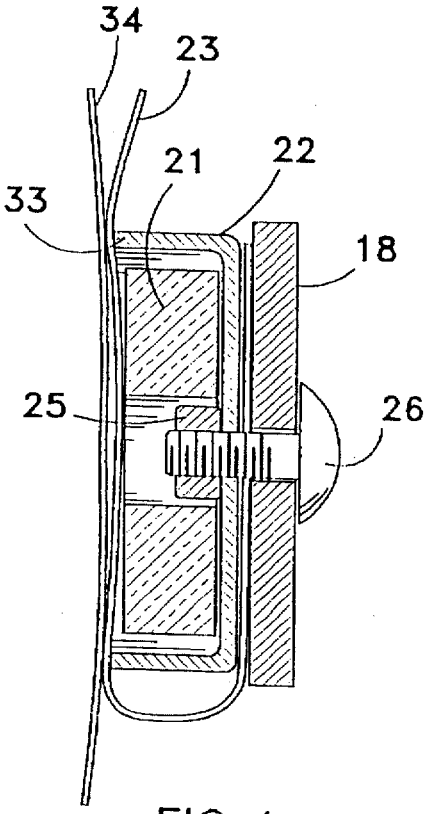
FIG. 4 is cross-sectional view of a portion of the magnet assembly of the tray of FIG. 1.

The first magnet assembly 16 is pivotly held to left side wall 15 and includes means for tightening the assembly against the left side wall 15. These means include a bolt 27 which extends through a hole 28 in left side wall 15 and also through a rubber washer 29. Bolt 27 also extends through a hole 30 in tray arm portion 19 and is secured by a wing nut 31. Identical parts are similarly held independently to right side wall 13 and it is important that the first magnet assembly 16 may be independently adjusted with respect to second magnet assembly 32. Since cup 22 is a ferromagnetic steel cup, its face 33 can potentially scratch a painted surface. While this is typically not a problem when the tray is held within the engine compartment, it can cause a problem when the tray is attached, for instance to the surface of a painted fender. Thus, cushioning sheets 23 are large enough to fold over the magnet faces 33 as shown best in FIG. 4 of the drawings. This same sheet, if not folded upwardly as shown in FIG. 4, permits the magnet face 33 to directly contact a ferromagnetic surface 34.

Figure 3:
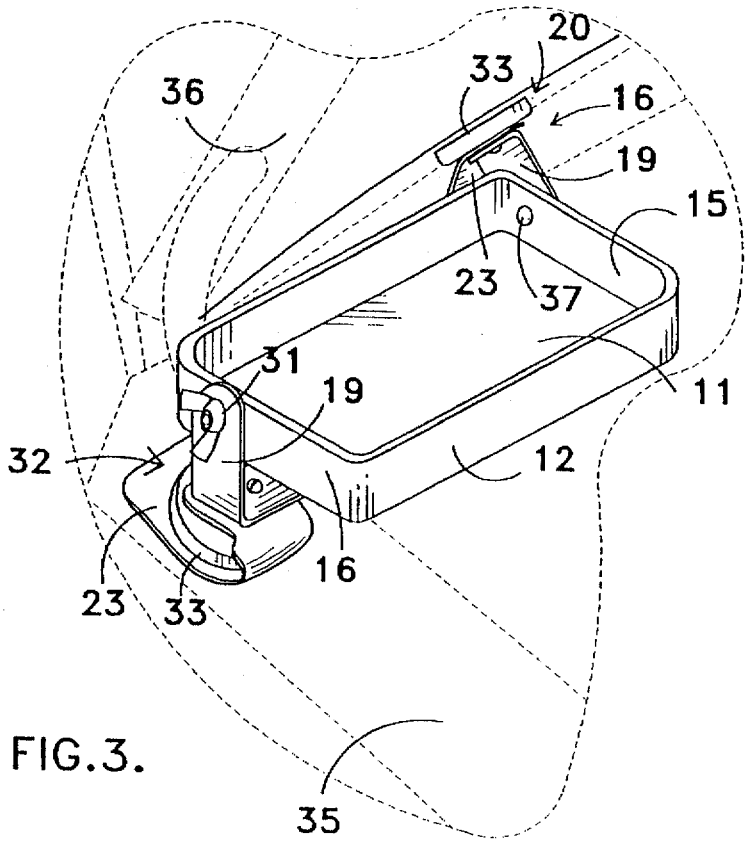
FIG. 3 is a perspective view of the mechanic's tray of FIG. 1 shown affixed to an engine compartment shown in phantom view.

The independent adjustments of the magnet assemblies 16 and 32 also permit the tray to be held to a highly irregular surface as shown in FIG. 3. In FIG. 3 the second magnet assembly 32 is held against the top of fender 35. This being a painted surface, the cushioning sheet 23 is folded under the face 33 of the magnet 20 of the second magnet assembly 32. The first magnet assembly 16 is pivoted upwardly so that the face 33 contacts the underside of the frame of hood 36. Since this is a surface which is not highly polished, the cushioning sheet 23 need not be folded up over the face 33 of the magnet 20 of magnet assembly 16. Because of the independent ability to adjust magnet assembly 16 and magnet assembly 32, it is possible that the tray can be held in almost any environment.

While the magnet assemblies are shown as being held by a wing nut, other tightening means can, of course, be used. The cushioning sheet is preferably a soft and flexible material such as fabric-backed polyvinyl chloride sheeting.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A mechanic's tray for holding parts while servicing machinery, said tray comprising:

a tray having a floor and four walls comprising a front wall, a right side wall, a left side wall and a back wall;

a first magnet assembly pivotally held on a magnet support arm held by said tray, said first magnet assembly and support arm including means for tightening said support arm and said first magnet assembly in a desired position, said first magnet assembly including a magnet and a ferromagnetic cup having a magnet face; and a second magnet assembly pivotally held on a magnet support arm by said tray and independently movable with respect to said first magnet assembly, said second magnet assembly and support arm also including means for tightening said second magnet assembly and support arm in a desired position, and said second magnet assembly including a magnet and a ferromagnetic cup having a magnet face whereby said tray is affixable to a ferromagnetic surface and adjustable to a desired position; and wherein said first and second magnet assemblies each include a cushioning sheet foldable over the face of the magnet to protect a ferromagnetic surface to which it is contacted, said cushioning sheet comprising a flexible sheet affixed to said support arm and extending away from said support arm and being sufficiently large so that it may be folded over the magnet face and sufficiently flexible so that it may be folded away to expose said magnet face.

2. The mechanic's tray of claim 1 wherein said first and second magnet assemblies each include an angled support member having a tray arm and a magnet arm, said tray arm being parallel to the right and left side walls and the magnet arm being movable so that it is parallel to the back wall and said tray arm of each of said first and said second magnet assemblies being pivotally securable to the right and left side walls respectively and each magnet arm having a magnet affixed thereto.

3. The mechanic's tray of claim 2 wherein each magnet has a flexible cushioning sheet held between the magnet and the magnet arm, and said cushioning sheet being sufficiently large so that it may be folded over the magnet face of the magnet to which it is held.

4. The mechanic's tray of claim 3 wherein when each of the magnet assemblies are positioned so that their magnet arm is parallel to the floor of the tray the cushioning sheet of each magnet assembly hangs downwardly and away from the face of each of the respective magnets.

5. The mechanic's tray of claim 3 wherein the tray arm of said first magnet assembly is tightenable to the right side wall and the tray arm of the second magnet assembly is tightenable to the left side wall.

* * * * *